US011448031B2

(12) United States Patent
Osen

(10) Patent No.: US 11,448,031 B2
(45) Date of Patent: Sep. 20, 2022

(54) WELLHEAD LOAD RELIEF DEVICE

(71) Applicant: EQUINOR ENERGY AS, Stavanger (NO)

(72) Inventor: Per Osen, Oslo (NO)

(73) Assignee: EQUINOR ENERGY AS, Stavanger (NO)

( * ) Notice: Subject to any disclaimer, the term of this patent is extended or adjusted under 35 U.S.C. 154(b) by 112 days.

(21) Appl. No.: 16/757,116

(22) PCT Filed: Nov. 27, 2018

(86) PCT No.: PCT/NO2018/050296

§ 371 (c)(1),
(2) Date: Apr. 17, 2020

(87) PCT Pub. No.: WO2019/103625

PCT Pub. Date: May 31, 2019

(65) Prior Publication Data

US 2021/0372221 A1 Dec. 2, 2021

(30) Foreign Application Priority Data

Nov. 27, 2017 (GB) ..... 1719649

(51) Int. Cl.
*E21B 33/038* (2006.01)
*E21B 19/16* (2006.01)

(52) U.S. Cl.
CPC ..... *E21B 33/038* (2013.01); *E21B 19/16* (2013.01)

(58) Field of Classification Search
CPC ..... E21B 33/038; E21B 19/16
See application file for complete search history.

(56) References Cited

U.S. PATENT DOCUMENTS 4,284,143 A 8/1981 Scherrer et al.
4,461,354 A * 7/1984 Buras ..... E21B 19/16 166/343

(Continued)

FOREIGN PATENT DOCUMENTS

WO 98/04805 2/1998
WO 2012/065896 5/2012

(Continued)

OTHER PUBLICATIONS

International Search Report dated Feb. 28, 2019 in International (PCT) Application No. PCT/NO2018/050296.
Search Report dated Mar. 26, 2018 in GB Application 1719649.4.

*Primary Examiner* — Aaron L Lembo
(74) *Attorney, Agent, or Firm* — Wenderoth, Lind & Ponack, L.L.P.

(57) ABSTRACT

A wellhead load relief device for reducing riser system induced load effects on a subsea wellhead and a method of installing a subsea wellhead assembly onto a subsea wellhead using the wellhead load relief device. The wellhead load relief device includes: a receptacle for receiving well control equipment, wherein the receptacle has an open top to permit the well control equipment to be received in the receptacle; and an adjustable support mechanism for rigidly supporting well control equipment received in the receptacle. The adjustable support mechanism is located within the receptacle and the adjustable support mechanism has a lateral extent that is adjustable relative to the receptacle. The wellhead load relief device is for providing a load path for forces exerted on the well control equipment to the seabed without going via the subsea wellhead. A subsea wellhead assembly including the wellhead load relief device is also provided.

20 Claims, 12 Drawing Sheets

(56) References Cited

U.S. PATENT DOCUMENTS

| | | | | |
|---|---|---|---|---|
| 4,822,212 | A * | 4/1989 | Hall | E21B 33/043 405/227 |
| 6,494,268 | B1 | 12/2002 | Ljungdahl et al. | |
| 9,074,447 | B1 * | 7/2015 | Cox | E21B 41/0007 |
| 9,080,408 | B2 * | 7/2015 | Mogedal | E21B 41/08 |
| 9,284,806 | B2 * | 3/2016 | Gutierrez | E21B 41/04 |
| 9,797,224 | B1 * | 10/2017 | Stewart | E21B 41/0007 |
| 9,845,654 | B2 * | 12/2017 | Hopper | E21B 33/037 |
| 10,724,349 | B2 * | 7/2020 | Osen | E21B 41/08 |
| 10,753,168 | B2 * | 8/2020 | Osen | E21B 33/076 |
| 2012/0273212 | A1 * | 11/2012 | Anderson | E21B 33/038 166/340 |
| 2013/0098627 | A1 * | 4/2013 | Jordan | E21B 33/038 166/355 |
| 2013/0105171 | A1 * | 5/2013 | Strand | E21B 33/035 166/363 |
| 2014/0374115 | A1 * | 12/2014 | Kebadze | E21B 41/0007 166/345 |
| 2016/0186517 | A1 | 6/2016 | Hopper et al. | |
| 2019/0271205 | A1 * | 9/2019 | Montifar | E21B 33/03 |
| 2019/0376250 | A1 * | 12/2019 | Grytdal | E21B 41/08 |
| 2020/0018133 | A1 * | 1/2020 | Rein | E21B 33/038 |
| 2021/0348467 | A1 * | 11/2021 | Baskett | E21B 17/01 |

FOREIGN PATENT DOCUMENTS

| | | | | |
|---|---|---|---|---|
| WO | 2016/085348 | | 6/2016 | |
| WO | 2016/118019 | | 7/2016 | |
| WO | WO-2021006743 | A1 * | 1/2021 | E21B 17/01 |

* cited by examiner

WELLHEAD LOAD RELIEF DEVICE

The invention relates to a wellhead load relief device, a subsea wellhead assembly comprising the wellhead load relief device and a method of installing a subsea wellhead assembly comprising the wellhead load relief device.

A typical subsea assembly comprises a subsea wellhead to which a subsea riser and well control equipment, such as a blowout preventer (BOP) and/or a Christmas tree (XT) (which may also be referred to as a subsea tree, SST) may be connected. The subsea riser system equipment is connected (downwards) to the wellhead and is typically connected (upwards) to a riser that extends between this riser system equipment and a surface facility. The riser typically provides a conduit for the drill string and drilling fluids between the subsea well and the surface facility.

It is important that the integrity of the wellhead assembly (including the wellhead housing and wellhead casing) is maintained so that structural failure and uncontrolled release of well fluids does not occur. Consequently, it is necessary to keep actual riser loads into the wellhead sufficiently below critical load levels for the wellhead and associated components.

WO 2016/118019 discloses an assembly in which subsea riser system equipment (e.g. a BOP) is tethered to a subsea template by tensioned lines so as to reduce loads on the wellhead. However, it has been found that installation and retrieval of this arrangement can be relatively time consuming and cumbersome. Therefore, it is desired to provide an assembly in which installation and retrieval can be simplified and/or in which the loads on the wellhead can potentially be reduced further.

In a broadest aspect the present invention provides a wellhead load relief device, the wellhead load relief device comprising: a receptacle for receiving well control equipment; and an adjustable support mechanism for supporting well control equipment received in the receptacle.

The device may be for reducing riser system induced load effects on a subsea wellhead. The receptacle may have an open top to permit the well control equipment to be received in the receptacle. The adjustable support mechanism may be for rigidly supporting the well control equipment received in the receptacle. The support may comprise and/or essentially be lateral, i.e. horizontal, support. The adjustable support mechanism may be located within the receptacle of the wellhead load relief device. The adjustable support may have a lateral extent that is adjustable relative to the receptacle. The wellhead load relief device may be for providing a load path for forces exerted on the well control equipment to the seabed without going via the subsea wellhead.

Thus, in a first aspect the present invention may provide, a wellhead load relief device for reducing riser system induced load effects on a subsea wellhead, the wellhead load relief device comprising: a receptacle for receiving well control equipment, wherein the receptacle has an open top to permit the well control equipment to be received in the receptacle; and an adjustable support mechanism for rigidly supporting the well control equipment received in the receptacle, wherein the adjustable support mechanism is located within the receptacle of the wellhead load relief device and wherein the adjustable support has a lateral extent that is adjustable relative to the receptacle, and wherein the wellhead load relief device is for providing a load path for forces exerted (e.g. exerted by the riser system) on the well control equipment to the seabed without going via the subsea wellhead.

In a second aspect the present invention provides a subsea wellhead assembly, the assembly comprising: a wellhead load relief device for reducing riser system induced load effects on a subsea wellhead, the wellhead load relief device comprising: a receptacle for receiving the well control equipment, wherein the receptacle has an open top to permit the well control equipment to be received in the receptacle; and an adjustable support mechanism for rigidly supporting the well control equipment received in the receptacle, wherein the adjustable support mechanism is located within the receptacle of the wellhead load relief device and wherein the adjustable support has a lateral extent that is adjustable relative to the receptacle, and wherein the wellhead load relief device is for providing a load path for forces exerted on the well control equipment to the seabed without going via the subsea wellhead; and well control equipment attached to a subsea wellhead and located within the receptacle, wherein the adjustable support mechanism supports (e.g. firmly/rigidly supports) the well control equipment within the receptacle.

The wellhead load relief device of the first aspect may be used in the assembly of the second aspect, and/or the wellhead load relief device of the second aspect may be the wellhead load relief device of the first aspect.

The likelihood of structural failure of the wellhead assembly due to high static or variable loads may be maintained as low as possible.

The device and/or assembly is/are for, or used for, reducing riser system induced load effects on the subsea wellhead. Thus the present invention may be considered to provide a device, assembly or method for reducing riser system induced load effects in subsea wellheads.

The wellhead load relief device may reduce horizontal shear loads and/or bending moments that act on the wellhead compared to an assembly without such a wellhead load relief device.

The wellhead load relief device may thus accommodate horizontal shear loads.

The wellhead load relief device may distribute the riser induced loads into the foundation/template, away from the wellhead and/or wellbay area.

This may be achieved by the wellhead load relief device supporting the wellhead control equipment.

The wellhead load relief device provides a load path for forces exerted on the well control equipment to the sea bed without going via the wellhead.

In other words, the wellhead load relief device may be for providing an additional load path for riser induced forces exerted on the well control equipment to the seabed, thereby substantially reducing load effects in the subsea wellhead.

The assembly may comprise a subsea well with a subsea wellhead. The subsea wellhead may comprise a wellhead housing. The wellhead housing may support a wellhead casing. The well control equipment may be fluidly and/or mechanically attached to the wellhead (e.g. wellhead housing).

The well control equipment may extend vertically up from the wellhead away from the sea bed. The well control equipment may be connected (i.e. fluidly connected) at its other end (directly or indirectly) to a riser, the upper end of which may be connected to a surface facility such as a floating vessel.

The well control equipment may be attached to the wellhead to facilitate or improve the safety of operations such as drilling and completion in the well.

The well control equipment may for example comprise, be, or part of, a blowout preventer (BOP), a Christmas tree, well intervention equipment, and/or other specialty or emergency control equipment such as a subsea capping stack or combinations thereof.

The present invention may be particularly advantageous for supporting a BOP. This is because BOPs are typically the largest and heaviest well control equipment mounted on a subsea wellhead.

A BOP may comprise a lower stack and a lower marine riser package (LMRP). The assembly may be arranged so that only the, or part of the, lower stack is received in the receptacle, i.e. the LMRP is not received within the receptacle. The LMRP may be located above the receptacle. The adjustable support mechanism may contact and support the lower stack of the BOP. The lower marine riser package may not be received in the receptacle and may not be contacted or supported by the adjustable support mechanism. This is so that, if required, the lower marine riser package may be easily and quickly released from the lower stack and retrieved from the assembly even if the wellhead load relief device is being used to support the BOP lower stack.

The support mechanism may be a lateral and/or transverse support mechanism, i.e. it may support the well control equipment received in the receptacle in directions that are substantially perpendicular to the main axis of the well control equipment and/or well assembly. This main axis may, e.g. usually, be in direction that is substantially vertical and parallel to the direction of gravity.

This may also be referred to as a radial support mechanism.

The support mechanism is for rigidly and/or firmly supporting the well control equipment in the receptacle of the device.

The support mechanism connects (e.g. rigidly and/or firmly connects) the well control equipment to the receptacle of the device.

The support mechanism may provide a load path for loads to be transferred from the well control equipment into the wellhead load relief device, e.g. into the receptacle, and then ultimately into the sea floor (to which the wellhead load relief device is directly or indirectly connected).

The well control equipment, e.g. BOP, may be directly connected to the wellhead. Alternatively, the BOP may be connected to the wellhead via another component, such as another well control equipment, such as a Christmas tree (which may also be referred to as a xmas tree or subsea tree for example).

The connection (direct or indirect) between the well control equipment and the wellhead (e.g. wellhead housing) may be a rigid connection.

The wellhead load relief device supports the well control equipment such that it provides an alternative load path for forces exerted on the well control equipment to the seabed other than a load path that goes via the wellhead.

The wellhead load relief device may be directly or indirectly connected to the seabed in addition to the indirect connection via the wellhead. This allows at least some forces to be transferred from the wellhead control equipment into the seabed without going via the wellhead.

The assembly may comprise a foundation, e.g. a template, mud mat(s), suction anchor(s) and/or pile(s). The foundation may be located about the wellhead. The foundation may be a wellhead foundation. The foundation may be fixed relative to the wellhead. The foundation may be fixed to the seabed, for example via suction cans, suction piles or buckets, driven piles, or mud mats (depending on the material and properties of the surface being fixed to), so as to be fixed in a location relative to the location of the wellhead. The wellhead foundation may be located about the wellhead and/or may support the wellhead. The foundation, e.g. template, may be a preexisting foundation, i.e. a foundation that would be there anyway even if a wellhead load relief device is not being used. Thus the foundation may have a purpose other than a connection point for the wellhead load relief device.

The foundation may be above or around the well bay area.

The wellhead load relief device may be connected (directly or indirectly) to the foundation. This allows forces to be transferred from the wellhead control equipment into the seabed without going via the wellhead.

The foundation may be associated with a plurality of wellheads, for example, the foundation may be associated with four wellheads.

The wellhead load relief device may be mounted on, connected to and/or latched to the foundation. This may permit forces to be transmitted via the wellhead load relief device from the well control equipment to the foundation.

The wellhead load relief device may be dimensioned so that when it is connected to the foundation, e.g. template, it does not obstruct operations on any of the other wellheads associated with the foundation. For example, it may not obstruct the landing of well control equipment such as a BOP on an adjacent wellhead and/or the locating of a protection cover over an adjacent wellhead.

For example, the wellhead load relief device may have outer dimensions that are between about 5 and 10 m by about 5 and 10 m, for example about 7.5 by 7.5 m.

The foundation may be rigidly connected to the sea floor. The wellhead foundation may provide a load path for forces to the sea bed that is not via the wellhead (i.e. wellhead housing and wellhead casing).

If the foundation is a template it may be a protection frame/envelope that extends up from and is raised off the surface on which it is located and surrounds and protects the subsea wellhead. This surface may for example be the sea bed or if the template is located in a dug-out recess in the seabed, the surface may be the bottom of the dug-out hole.

The wellhead load relief device may be rigidly connected to the foundation. The receptacle of the wellhead load relief device may be connected, for example rigidly connected, to the foundation. This may be via one or more connectors. The bottom end of the receptacle may be equipped with these connectors. There may be a plurality of connectors for connecting/latching the wellhead load relief device to the sea bed (e.g. via a foundation). The connectors may be operable by ROVs. The connectors may be attached to the receptacle at or near the bottom of the receptacle. This is so that they are near the structure (e.g. seabed/foundation) onto which in use they will be latched.

The connectors may be spaced substantially equally around the bottom of wellhead load relief device, e.g. around the bottom of the receptacle. For example one or more connectors may be provided on one side of the device, e.g. receptacle, and one or more connectors may be provided on the opposite side of the device, e.g. receptacle. This may help facilitate there to be a relatively even and/or efficient load transfer between the wellhead load relief device and the structure to which it is connected.

The wellhead load relief device may additionally or alternatively comprise one or more support/landing pads. These are for contacting and supporting the receptacle on the foundation. The wellhead load relief device may comprise for example four support pads. These may contact the foundation and help locate the wellhead load relief device on the foundation and/or help provide a firm and reliable connection between the wellhead load relief device and foundation such that forces can be efficiently transferred from the wellhead load relief device into the foundation.

When the device comprises one or more support/landing pads the device may only require one connector to latch it to the foundation.

The wellhead load relief device, e.g. the receptacle of the device, may be a rigid structure. The wellhead load relief device may be made of a rigid material (rigid being with reference to the typical forces by subsea wellhead equipment). For example, the wellhead load relief device may be made of steel.

The wellhead load relief device may be referred to as a cage. In the case that the well control equipment received in the receptacle is a BOP, the wellhead load relief device may be referred to as a BOP cage.

The wellhead load relief device comprises a receptacle that may surround or be for surrounding the well control equipment. For example, the receptacle may surround/be for surrounding the well control equipment around at least part of its outer perimeter. The receptacle may surround the entire perimeter of the well control equipment.

If the well control equipment is approximately square shaped in cross section, the receptacle may surround/be for surrounding the well control equipment on all four sides.

The receptacle has an open top and may have an open bottom. This may permit the well control equipment to be received in the receptacle and/or easily attached to components such as wellhead or another well control equipment underneath the receptacle.

The well control equipment may be received in the receptacle by being lowered into the receptacle and connected to the wellhead.

The receptacle may be a frame.

The receptacle may be formed from a truss of beams.

The receptacle may have a box shape that has an open top and/or open bottom.

The receptacle, e.g. frame, may extend continuously around the well control equipment (e.g. BOP). For example the receptacle may comprise at least one component, e.g. horizontal bar, that extends continuously around the outer perimeter of the subsea well control equipment. The receptacle may comprise three (e.g. at least three) components, e.g. horizontal bars, that extend continuously around the perimeter of the subsea well control equipment. These may be provided at or near the top, middle and bottom of the receptacle.

For example, one of these components may be located at or near the bottom of the well control equipment received within the receptacle, one of these components may be located at or near the middle of the well control equipment received within the receptacle and one of these components may be located at or near the top of the well control equipment received within the receptacle.

The receptacle may not be a continuous frame/box. For example, the receptacle may have openings and/or slots, and/or comprise separate walls.

The receptacle, e.g. frame, may comprise one or more components, e.g. vertical bars, that extend over the height of the receptacle. These components may connect together (e.g. rigidly connect) the components, e.g. horizontal bars, that extend around the perimeter of the well control equipment. There may be for example four vertical components that in the case of a receptacle with a substantially square or rectangular cross section are located at the corners of the receptacle.

These horizontal and vertical components may be referred to as braces and may be rigidly connected together to form a rigid frame. The receptacle may also comprise obliquely extending braces. This may increase the rigidity and inherent stiffness of the receptacle that may help reduce wellhead loads.

The receptacle, e.g. frame, may have a substantially open structure (e.g. open between the vertical and horizontal components) that permits access, such as by means of an ROV, to certain parts of the subsea well control equipment when this is received in the receptacle.

The receptacle may have an adjustable height, and/or the adjustable support mechanism may have an adjustable height (i.e. adjustable elevation). This may enable the wellhead load relief device to be used with various different well control equipment with different geometries and sizes and/or with well control equipment irrespective of whether it is directly connected to the wellhead or whether there are additional components (such as another equipment such as a Christmas tree) between the wellhead and the well control equipment being received and supported in the receptacle. For example, the wellhead load relief device may be able to be used to receive and support a BOP irrespective of its height relative to the structure, e.g. foundation or sea bed, to which the wellhead load relief device attaches. For example, the wellhead load relief device may include means for height adjustment, to allow it to be used to receive and support a BOP irrespective of whether the BOP is directly connected to the wellhead or it is mounted on a Christmas tree that is connected to the wellhead.

The elevation (i.e. height) of the support mechanism may be adjustable relative to the connectors and/or support pads that connect the wellhead load relief device with the subsea well template, i.e. the distance between the connectors/bottom of the device and the support mechanism may be adjustable.

The elevation (i.e. height) of the adjustable support mechanism may be adjustable relative to the well control equipment. This is so the support mechanism may be adjusted so that it contacts a particular part of the well control equipment, such as a top portion of the well control equipment (e.g. the top level of the BOP lower stack).

The length and/or height of the receptacle may be adjustable.

The adjustable height may be achieved by the receptacle having a top part and a bottom part, wherein the top part can be moved relative to the bottom part. The top part may be movable from a retracted position in which the receptacle has its minimum length to an extended position in which the receptacle has its maximum length. For example, there may be a telescopic connection between the top and bottom parts that permits the height of the receptacle to be adjusted. The wellhead load relief device may comprise one or more actuators, e.g. telescopic control jacks. These actuators, e.g. jacks, may be used to control the extension and retraction between the top part and bottom part of the receptacle.

The adjustable support mechanism may provide lateral (e.g. radial and/or horizontal) support to the subsea well control equipment from the receptacle and hence structure to which the receptacle is connected. The adjustable support mechanism may additionally provide axial (e.g. vertical) support to the subsea well control equipment.

The wellhead load relief device, e.g. adjustable support mechanism, may be used to prevent lateral movement of the well control equipment inside the receptacle.

Once the well control equipment is received within the receptacle the adjustable support mechanism may be adjusted so that it acts in compression against the well control equipment.

The adjustable support mechanism may comprise a locking means. This is so that once it is adjusted to contact and/or urge against the well control equipment it may be locked in place.

Thus, the adjustable support mechanism may be arranged so that it can exert a force on the well control equipment. This may be an axial compressive force.

The device may laterally (e.g. horizontally) support the top end (e.g. receiver plate) of the well control equipment (e.g. lower stack of a BOP).

The adjustable support mechanism may be adjusted to provide a static preload onto the well control equipment.

The device may provide a wellhead load reduction effect. This may be achieved by the device being very rigid, and being rigidly connected relative to the seafloor, e.g. mounted to a rigid foundation. The wellhead load reduction effect may be achieved by variable reaction forces between the device and the well control equipment, which may minimise the variation on wellhead bending moments.

By lateral support it may be meant that the well control equipment is supported in directions that are substantially parallel (or at least partially parallel) to the surface of sea bed, substantially perpendicular to the direction of gravity, and/or substantially perpendicular to the axis of the wellhead. When the well control equipment is connected to a substantially vertical wellhead, the lateral direction may be substantially horizontal.

The adjustable support mechanism permits forces to be transferred from the well control equipment to the receptacle.

This support may be provided during drilling, completion, and/or workover modes of operation of the wellhead assembly.

The wellhead load relief device (via the adjustable support mechanism) in use laterally supports the well control equipment and/or reduces the loads, e.g. bending moments, transferred to the wellhead from the well control equipment and riser compared to an assembly without any wellhead load relief device.

The support mechanism may be arranged to be at or near the top of the receptacle. This may allow the support mechanism to be connected to the well control equipment at the highest possible location (whilst not being in conflict with requirements to have unobstructed (emergency) release of the riser from the well). For example, the wellhead load relief device may permit, i.e. not obstruct, release of the LMRP from the BOP lower stack. This allows the riser to be quickly released from the well, e.g. in an emergency situation.

This may help to reduce the loads, e.g. bending moments, that are exerted on the wellhead. The method of connecting the receptacle to the well control equipment using the support mechanism may comprise connecting the support mechanism to the well control equipment as high at possible (e.g. on an uppermost portion of a lower stack of the BOP). This may be achieved by adjusting the length of the receptacle and/or height of the support mechanism so that the connection is close to the top of the well control equipment received in the receptacle.

It may be desired for the connection between the wellhead load relief device and the well control equipment to be as high as possible above the wellhead. This is so the device can effectively reduce bending moments that are put on the wellhead. However, this may be as high as practical, i.e. as high as possible without interfering with safety device, e.g. allowing emergency release of an LMRP from a BOP lower stack.

When the well control equipment (e.g. the BOP) is laterally supported by the receptacle connected to the seabed, it is possible for the loads transferred to the wellhead from the riser system (which includes the riser and the well control equipment) to be reduced (e.g. substantially reduced), for example loads due to well control equipment or riser movements. These loads may be cyclic fatigue loads and/or accidental or abnormally high single-loads. The wellhead load relief device may reduce the loads transferred to the wellhead from the well control equipment by 25% or more or 50% or more, (e.g. at least 25%, at least 30%, at least 40%, at least 50%, 50% to 60%, at least 60% or at least 75%) compared to an arrangement that does not use such a wellhead load relief device.

Compared to an arrangement with tensioned wires (e.g. tensioned steel ropes), the wellhead load relief device described herein (e.g. the 'BOP cage') may be relatively straightforward to install due to it being able to be installed in one piece. Compared to an arrangement with tensioned wires, the wellhead load relief device may be able to more efficiently reduce the wellhead head loads due to the high stiffness of the receptacle structure.

The support mechanism is adjustable in the sense that its lateral extent (e.g. relative to the wellhead that the wellhead load relief device is located about) is adjustable.

The adjustable support mechanism may be connected to an upper portion, e.g. the top part, of the receptacle. The connectors for connecting the wellhead load relief device to the seabed (e.g. directly or indirectly via a foundation) may be connected to the bottom part of the receptacle. Thus, the adjustable support mechanism may have a height that can be adjusted relative to the foundation/template, wellhead and/or connectors for connecting the wellhead load relief device to the foundation/template.

The adjustable support mechanism is located within the receptacle of the wellhead load relief device. The adjustable support has a lateral extent that is adjustable relative to the receptacle. In other words, the adjustable support mechanism may be moved inwards towards the centre of the receptacle so as to contact the well control equipment received within the receptacle.

The adjustable support mechanism may be adjustable to change the minimum inner dimension, e.g. width/diameter, of the receptacle in which the well control equipment is received. Thus, the adjustable support mechanism may be adjusted to contact and to provide support to the well control equipment received within the receptacle.

The adjustable support mechanism may comprise one or more adjustable support elements. These may be adjustable (i.e. movable) relative to the receptacle so as to adjust the internal dimensions, e.g. cross sectional area, within the receptacle at the point the adjustable support elements are provided. Thus, adjustable may refer to the length of the support element and/or the distance of the inner surface of the support element that contact the well control equipment from the receptacle. Thus, the support mechanism may be referred to as an adjustable length support mechanism.

The adjustable support element(s) may for example be extendable and retractable arms, movable bumper bar(s) or any other component that can contact and support the well control equipment received in the receptacle and for which the position relative to the receptacle can be adjusted to change the internal minimum cross sectional area of the receptacle.

The adjustable support elements may each comprise a compliant material, such as rubber, on at least the surface that contacts the well control equipment.

The adjustable support mechanism may comprise a plurality of adjustable support elements. The adjustable support elements may be arranged to contact certain contact points on the well control equipment. For example, these may be brackets which are attached to the frame of the well control equipment prior to deployment subsea. For example, four brackets may be attached to the well control equipment (for example one at each corner of the frame of the well control equipment). Thus, the assembly may comprise a subsea well control equipment with brackets (i.e. points at which the support element can contact the BOP) mounted on the structure of the well control equipment.

The contact points may be a top plate (e.g. receiver plate) of a BOP lower stack frame.

The usual standard frame of the well control equipment may be received in the receptacle of the wellhead load relief device, to provide the required wellhead load relief effect. Thus the wellhead load relief device may be arranged such that no modification of the well control equipment is required.

Each adjustable support element may be opposite (on the other side of the receptacle) another support element. These opposite support elements may be arranged to that they extend and retract and hence exert forces in opposite directions to each other. This is so that support may be provided evenly to the well control equipment received within the receptacle. The well control equipment may be effectively clamped between two opposite support elements. The support elements may be arranged to exert a preload. The support elements may be arranged to be locked in position, e.g. after they have been adjusted.

The adjustable support elements may be provided so that there is at least one support element (e.g. two support elements) on each side of the receptacle.

The adjustable support elements may be arranged so that lateral support is provided to the well control equipment at two different axial heights.

The support elements may be provided at or towards the corners of the receptacle. This is because often well control equipment is strongest, have suitable contact points, and/or have suitable points for the attachment of brackets at the corners of the equipment.

For example, two support elements (which may for example be perpendicular to each other) may be provided towards each corner of the receptacle. Thus, the wellhead load relief device may comprise eight support elements (two on each side towards opposite corners and opposite a support element on the opposite side of the receptacle). The support elements may be located at an off axial position.

Each adjustable support element may be individually adjustable. Alternatively or additionally, the support elements may be arranged (e.g. connected) so that they are adjusted (e.g. extended and retracted) together by a single adjustment mechanism (e.g. a single remotely operated vehicle (ROV) based actuator). For example, each support element may comprise an actuator, e.g. a jack, and all the actuators of the support elements may be connected. All of the actuators may be operated by one operation. This may help to ensure an even distribution of load and to minimise the risk that the well control equipment is misaligned due to the un-coordinated adjusting of the support elements.

The method may comprise adjusting each support element, e.g. bumper bar, individually until they each touch the well control equipment, e.g. the BOP, with a limited, i.e. small, force. Then, counter-acting support elements, e.g. forward and aft, may be connected (e.g. by worm gears) and then a preload be applied simultaneously (by the counter-acting support elements being adjusted simultaneously). This may prevent the possibility of unintentionally applying uneven preload and thus high wellhead bending moments.

One or more or each support element is arranged so that it may be adjusted using an ROV (e.g. by means of a torque tool).

Each adjustable support element may be movable from a retracted position to an extended position (e.g. from a deactivated to an activated position). The retracted/deactivated position may be that in which the internal minimum cross sectional area of the receptacle is at its maximum and the extended/activated position may be that in which the internal minimum cross sectional area of the receptacle is at a minimum. In practice one or more or each support element may be adjusted somewhere between its extended and retracted position to a position that is in contact with and supports the well control equipment received within the receptacle of the wellhead load relief device.

The well control equipment may be located into the receptacle when the support elements are retracted/deactivated and after the well control equipment is within the receptacle the support elements may be extended/activated so that they contact and press against the well control equipment.

The support mechanism may comprise two movable horizontal beams/bumper bars that are located on opposite sides of the receptacle and can move laterally towards each other in a transverse direction. The movable horizontal beams may extend the full width of the receptacle.

These may be ROV-operated adjustable bumper bars for example.

One or both or the movable beams may comprise one or two movable lateral supports. These supports may be integrated into the beams. The adjustment mechanism for the lateral supports may be housed within the movable beams.

The, some or each lateral supports may be movable in a direction that is different to that in which the movable beams move. For example, the, some or each lateral supports may be movable in a direction that is substantially perpendicular to the direction in which the movable beams can move.

The lateral supports may extend only over a portion of the width of the receptacle. This is so that they do not prevent the horizontal beams from being able to move laterally.

The support mechanism may be arranged so that the horizontal beams are moved by a common adjustment mechanism. The lateral supports may also have independent adjustment mechanisms. The adjustment mechanisms may be operated by an ROV.

The maximum outer dimension of the well control equipment may be smaller than the minimum inner dimension of the support elements when they are in their retracted position. The maximum outer dimension of the well control equipment may be larger than the minimum inner dimension of the support elements when they are in their extended position. There may for example be a clearance of at least 100 mm, e.g. about 500 mm, between the maximum outer dimension of the well control equipment and the minimum inner dimension of the support elements when they are in their retracted position.

The wellhead load relief device may be arranged (e.g. dimensioned) to cater for a specified vertical well misalignment (i.e. inclination). The specified maximum inclination may be in the range 0-2 degrees, e.g. up to 1 degree.

For example, the receptacle may be sized so that it can still receive and accommodate the well control equipment even if the subsea wellhead (onto which the well control equipment will be landed and latched) is tilted, e.g. up to 2 degrees.

This accommodation of inclination may be achieved by the use of the adjustable support mechanism.

The receptacle may be inclined relative to the foundation to which it connects, included to the wellhead, and/or inclined relative to the seafloor. This incline may be achieved by having an adjustable connection between the receptacle and the foundation/seabed to which it connects. This may allow the receptacle to be tilted if there is a wellhead inclination for example.

The adjustable support mechanism means that the wellhead load relief device may be used with different well control equipment with different geometries and/or sizes. This may also help ease installation, as the well control equipment may be received in the device when it has a larger minimum inner cross sectional area before the support elements are adjusted to reduce the inner cross sectional area to contact and support the well control equipment.

The receptacle may be generic for many different well control equipment and subsea wellhead assemblies. Alternatively, the support mechanism (i.e. support elements) may be specifically designed for a particular well control equipment (e.g. tailored to the contact points on the well control equipment). Thus, the support elements may be interchangeable depending on the well control equipment that the wellhead load relief device is intended to support. Thus, the support elements may be regarded as adapters for adapting the receptacle to be suitable for a specific well control equipment.

The adjustable support mechanism may also allow good contact between the device and the well control equipment. This may ensure that loads can be efficiently transferred from the well control equipment to the receptacle and ultimately to the sea floor rather than going via the wellhead itself.

The adjustable support mechanism may be preloaded to exert a force on the well control equipment received within the receptacle. This may ensure that loads are transferred efficiently to the seabed via the device rather than via the wellhead.

The adjustable support mechanism may connect the wellhead control equipment to the receptacle in compression and/or tension.

The support mechanism, e.g. the support elements, may comprise a compression device, e.g. ratchet, to allow for high compression force, e.g. up to 700 kN to be applied.

The support mechanism may comprise a tension device that acts to pull the well control element towards the receptacle.

The wellhead load relief device may comprise a guide, e.g. one or more guiding devices. This may be a guide for guiding (e.g. moving and/or aiding) the well control equipment into an appropriate position for being lowered into the receptacle and/or guiding the well control equipment into the receptacle. The guide may for example comprise a receptacle extension that extends from and above one (e.g. only one, two or three) sides of the receptacle. This may be used to guide the well control equipment into a suitable location above the receptacle to then be lowered into the receptacle. This may be achieved by, during installation, the well control equipment being lowered until it is at a height above the receptacle but at least partially below the uppermost part of the receptacle extension. The well control equipment may then be moved laterally until it contacts the receptacle extension. The well control equipment may then be lowered whilst against the receptacle extension until it is received within the receptacle of the wellhead load relief device.

The lowering of the well control equipment into the receptacle and onto the part to which it is connected (e.g. the wellhead or another well control equipment) may also be aided by the usual means of guide posts and guide wires for example.

The receptacle extension may be removable from the device. Thus, the receptacle extension may be removed after it has served its purpose of guiding the well control equipment into the receptacle.

The receptacle extension may have one or more bumpers (e.g. compliant portions) on its guiding surface for guiding the well control equipment into the receptacle.

The guide may comprise a funnel, i.e. guide funnel, that is movable (e.g. slidable) in the axial and/or vertical direction of the wellhead load relief device. During installation, it may be located towards the top of the wellhead load relief device to receive a bottom part (e.g. connector) of the subsea well control equipment. Once part of the subsea well control equipment is received in the guide funnel, the guide funnel may be lowered into the receptacle to thereby lower and guide the well control equipment into the receptacle of the device.

The guide may comprise one or more foldable latch arms. During installation, these arms may be located upwards out of the receptacle and may be arranged to receive and attach to a bottom part of the subsea well control equipment. Once part of the well control equipment is received by the foldable latch arms, the arms may be retracted/collapsed into the receptacle to thereby lower and guide the well control equipment into the receptacle of the device. Guide wires may be threaded through and/or laterally guided by the foldable latch arms to aid in guiding the well control equipment into the receptacle.

The receptacle may be open on one side or have a door that permits it to be opened on one side. This may be referred to as a side-access opening. This may allow the well control equipment to be guided in laterally into the receptacle rather than lowering it axially downwards into the receptacle.

The well control equipment may be received in the receptacle and contacted by the adjustable support mechanism before it is deployed subsea.

Alternatively, the wellhead load relief device may be deployed subsea, mounted on and connected and/or latched to the subsea wellhead foundation (e.g. template) by means of support pads and/or connectors on the receptacle of the device. Once the wellhead load relief device is mounted and/or connected to the subsea well foundation, the well control equipment (e.g. BOP) may be lowered and received in the receptacle of the wellhead load relief device. The well control equipment may be guided into the receptacle by a guiding device, e.g. a guide funnel structure.

The wellhead load relief device and/or the well control equipment may be deployed and retrieved to and from the seabed using one or more lift lines from a vessel at the surface of the water. The assembly may comprise a lifting structure, e.g. frame, which is mounted on and latched to the receptacle during installation and/or retrieval of the wellhead load relief device.

The method of deploying the wellhead load relief device may comprise connecting a lifting means, such as a drill string, to the lifting structure.

The wellhead load relief device may be lowered until it is over a wellhead/well slot. This may be aided by the use of guide wires connected to the top ends of guide posts as is well known in this field.

The wellhead load relief device may then be lowered further until it is connected to the seabed, e.g. via a foundation, and the wellhead load relief device may be latched to the seabed, e.g. via a foundation, using connectors as discussed above. These may be operated using a ROV. Once the wellhead load relief device is connected to the seabed, the lifting device may be disconnected from the wellhead load relief device and recovered.

The well control equipment may be lowered towards the wellhead load relief device mounted on the foundation until it is just above, e.g. around 0.5 to 1 m above, the device. It may then be guided into the receptacle, for example moved laterally until it contacts a receptacle extension against which it can be guided into the receptacle.

Guide wires and guideposts may be used to guide the well control equipment into the receptacle.

The well control equipment may enter the receptacle and be located onto guide posts within the receptacle.

Alternatively, the wellhead load relief device may be deployed after the well control equipment is mounted on the wellhead.

Alternatively, the wellhead load relief device may be deployed before the well control equipment is mounted on the wellhead. In this case the wellhead load relief device may initially be located below the vertical height of the well control equipment when mounted on the wellhead. The wellhead load relief device may then be raised up from a vertical height below the well control equipment to a position in line and around the well control equipment. For example, the installation procedure may be to deploy the wellhead load relief device and locate it beneath the location that the well control equipment will be installed, install the well control equipment, e.g. the BOP, hoist up the wellhead load relief device until around the well control equipment, and then activate the lateral support mechanism so as to support, e.g. clamp, the well control equipment in place.

The well control equipment may be landed on the component to which it is to be connected. The component to which it is connected for example may be a wellhead or another well control equipment such as a Christmas tree. The connector at the bottom of the well control equipment may be latched onto the component to which it is to be fluidly connected.

The well control equipment may be connected (directly or indirectly such as via another well control equipment) to the subsea wellhead. This may be before or after the well control equipment is received within the receptacle.

Once received within the receptacle, the adjustable support mechanism may be adjusted until it (e.g. one or more or each adjustable support element) contacts and/or supports the well control equipment. This may be achieved by adjusting the height of the support mechanism relative to the subsea well and then adjusting the extension of the support mechanism.

Connecting the subsea well control equipment to/within the device by the support mechanism may occur before or after the well control equipment is connected to the wellhead.

In another aspect, the present invention may provide a method of installing a subsea wellhead assembly, the method comprising, connecting a wellhead load relief device (as described above) to the seabed (e.g. such as by mounting it on and/or connecting it to on a foundation), locating well control equipment within the receptacle, attaching, i.e. connecting, the well control equipment to a subsea wellhead, and adjusting the adjustable support mechanism until they support the well control equipment within the receptacle. The steps of the method may be performed in any order or may be performed in the order in which they are recited. The well control equipment may be installed together with the wellhead load relief device, e.g. the well control equipment may be within the receptacle when they are deployed subsea.

Alternatively, they may be deployed separately. For example, the device may be connected located about the wellhead and then the well control equipment may be deployed subsea and received in the receptacle of the wellhead load relief device.

The well control equipment may be moved to another second wellhead after it has been installed (and optionally operated) on a first wellhead. The well control equipment may be moved to the second wellhead whilst it is within the receptacle of the wellhead load relief device. Thus, the wellhead load relief device may 'jump' along with the well control equipment from one well to another.

Thus the present invention may provide a method of moving well control equipment from a first wellhead to a second wellhead, the method comprising: providing a subsea wellhead assembly comprising a first wellhead, well control equipment mounted on the first wellhead, a wellhead load relief device comprising a receptacle in which the well control equipment is received, and an adjustable support mechanism for supporting the well control equipment received in the receptacle, the wellhead load relief device being connected to the sea bed (e.g. via a foundation) and supporting the well control equipment; disconnecting the wellhead load relief device from the seabed, disconnecting the well control equipment from the well head, moving the wellhead load relief device with the well control equipment located therein to above a second wellhead, connecting the well control equipment to the second wellhead, connecting the wellhead load relief device to the sea bed (e.g. a foundation located about the second wellhead). The method may comprise activating the adjustable support mechanism. This may be after the device has been connected to the second wellhead and/or the seabed. This may laterally support the well control equipment and thereby reduce the loads in the wellhead.

The method may comprise installing the wellhead load relief device and well control equipment relative to a first wellhead in accordance with the method described above.

The method may then comprise disconnecting the lower part of the wellhead load relief device from the seabed, e.g. foundation about the first wellhead. The method may comprise making additional connections between the receptacle and the well control equipment, e.g. latching the upper part of the receptacle to the well control equipment.

The lower part of the receptacle (if the receptacle is in two parts that may move relative to each other) may be retracted relative to the top part, e.g. using actuators, e.g. telescope control jacks, described above. The well control equipment may be disconnected from the wellhead.

The whole assembly comprising the wellhead load relief device and the well control equipment may then be lifted and moved to be located over another, second wellhead. The lower part may then be extended and connected to the sea bed (e.g. mounted onto the foundation (e.g. template)) about the second wellhead, e.g. again using the actuators, e.g. telescope control jacks, described above. The wellhead load relief device may be connected/latched onto the seabed.

The foundation, if present, may be the same foundation that was about the first wellhead (i.e. the same structure in the case that the foundation is the foundation for a plurality of wellheads) but the wellhead load relief device may be connected to a different part of the foundation. Alternatively, the foundation, if present, may be a different foundation to the first foundation. The device may then be connected to the seabed by the connectors of the device. If additional connections (e.g. latchings) were made between the upper part of the receptacle and the well control equipment these may be disconnected.

During such a jumping operation, the method may comprise releasing the support mechanism. The releasing of the adjustable support mechanism may be done before the well control equipment is connected to the second wellhead, for example it may be done before the well equipment is disconnected from the first wellhead. This may be to provide a small clearance between the receptacle and the well control equipment. The support mechanism may then be reactivated (for example, after the well control equipment has been attached to the second wellhead) to take up/close the clearances between the well control equipment and the receptacle and to provide axial force (e.g. compression) against the well control equipment.

If the method comprises releasing the support mechanism and this is performed before the well control equipment is moved to the second wellhead, the method may comprise connecting the wellhead load relief device to the well control equipment. This is so that the device may hang on to the well control equipment when the well control equipment is being moved.

The wellhead load relief device may be connected to the seabed (e.g. via a foundation) after the well control equipment is connected to the second wellhead.

The adjustable support mechanism may be adjusted until it supports the well control equipment after the well control equipment has been connected to the second wellhead and/or after the wellhead load relief device has been connected to the seabed about the second wellhead.

The method may comprise first landing the well control equipment onto the wellhead, then lowering and connecting the wellhead load relief device onto the foundation, and finally activating the lateral support mechanism.

This is because all wellheads will have individual inclinations relative to the foundation and thus the lateral support mechanism will need to be adjusted when the well control equipment is moved to a second wellhead.

The wellhead load relief device may thus provide an easy and convenient way of facilitating jumping of the well control equipment between wellheads subsea, with the wellhead load relief device following.

In another aspect, the present invention may provide a method of uninstalling well control equipment, the method comprising: providing a subsea wellhead assembly comprising a wellhead, a wellhead foundation about the wellhead, well control equipment mounted on the first wellhead; and a wellhead load relief device as described above; wherein the wellhead load relief device is connected to the seabed and/or supports the well control equipment; disconnecting the wellhead load relief device from the seabed; disconnecting the well control equipment from the well head; and retrieving the well control equipment and wellhead load relief device to the surface.

The well control equipment may (or may not) be retrieved to the surface together with the wellhead load relief device, e.g. whilst the well control equipment is within the wellhead load relief device. This may be achieved by unlatching/disconnecting the connectors of the device from the seabed, e.g. from the foundation. Optionally the method may comprise providing additional (e.g. essentially weight-carrying) connection/latching between the well control equipment and the wellhead load relief device (i.e. additional to the connection formed by the adjustable support mechanism). This may allow the well control equipment to be retrieved together with the wellhead load relief device (and vice versa).

The well control equipment (e.g. BOP) may be retrieved by the drilling rig.

The well control equipment may be retrieved out of the wellhead load relief device and retrieved to the surface separately from it.

A separate service vessel (e.g. a ship) may retrieve the wellhead relief device after the well control equipment has been retrieved. This may be the opposite of the initial installation in which the well control equipment may be installed when it is in the wellhead load relief device.

The well as referred to in the present specification may be an oil and/or gas well. The well may be a water injection well.

In an aspect the present invention provides a wellhead load relief device for reducing riser system induced load effects on a subsea wellhead, the wellhead load relief device comprising: a receptacle for receiving well control equipment, wherein the receptacle has an open top to permit the well control equipment to be received in the receptacle, and a bottom end equipped with devices to rigidly securing it to an existing subsea template structure above or around the wellbay area; and with an adjustable support mechanism for rigidly supporting the well control equipment received in the receptacle in essentially lateral (horizontal) directions, wherein the adjustable support mechanism is located within the receptacle at an elevation to provide lateral support to the well control equipment as high as practical, and wherein the adjustable support mechanism has a lateral (horizontal) extent that is adjustable relative to the receptacle such as to accommodate possible inclination of the wellhead and well control equipment, and wherein the wellhead load relief device is for providing an additional load path for riser induced forces exerted on the well control equipment to the seabed, thereby substantially reducing load effects in the subsea wellhead.

This wellhead load relief device may have one or more or all of the above described features and/or be used in one or all of more of the above described methods.

Certain preferred embodiments of the present invention will now be described by way of example only with reference to the accompanying drawings, in which.

Figure 1:
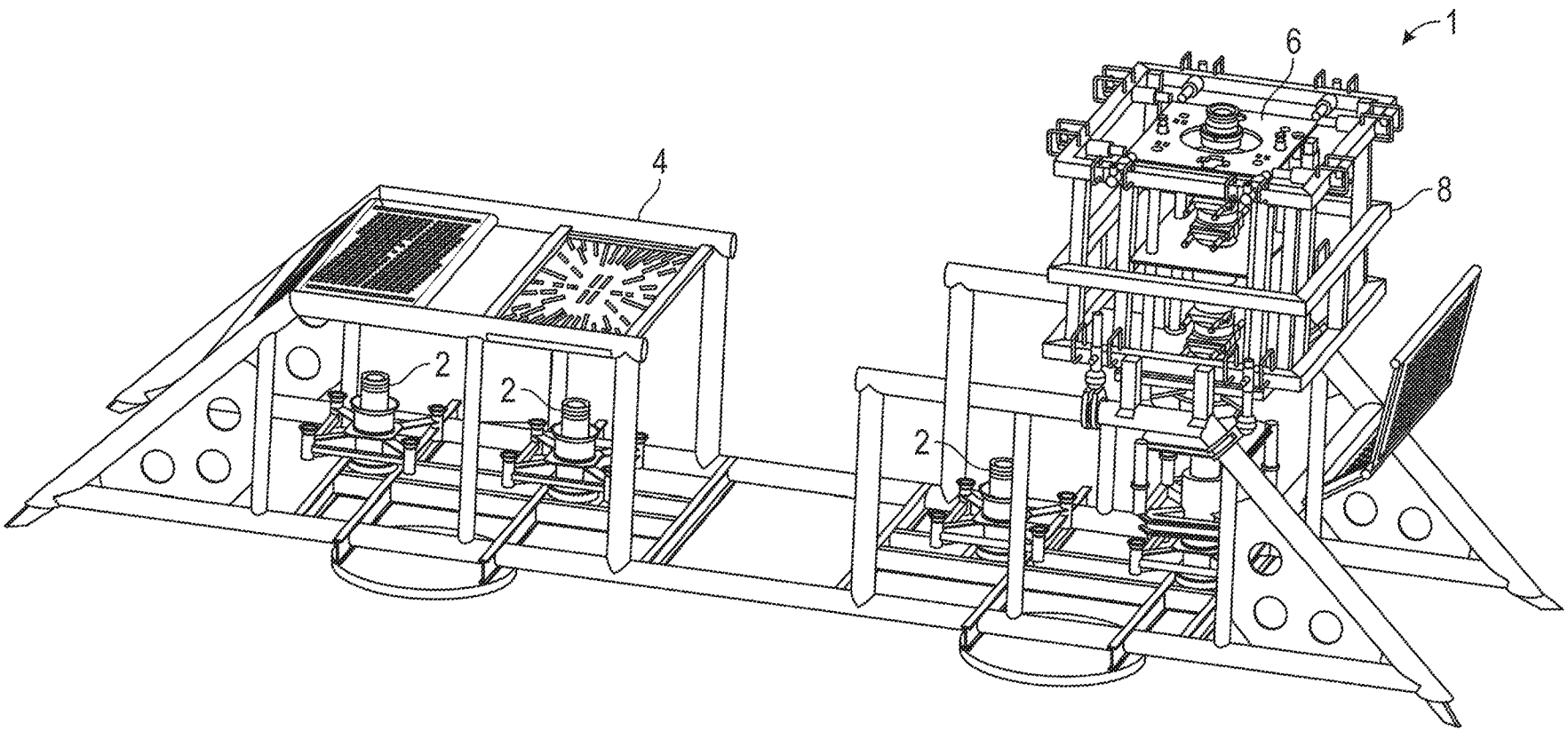
FIG. 1 shows a subsea wellhead assembly comprising a wellhead load relief device.

FIG. 1 shows a subsea wellhead assembly 1. This exemplary assembly 1 comprises four wellheads 2. The wellheads are surrounded by a common foundation, e.g. template 4. On the rightmost wellhead 2 is located a subsea well control equipment, in this case a blowout preventer (BOP) 6. The BOP 6 is located and supported within a wellhead load relief device 8.

Figure 2:
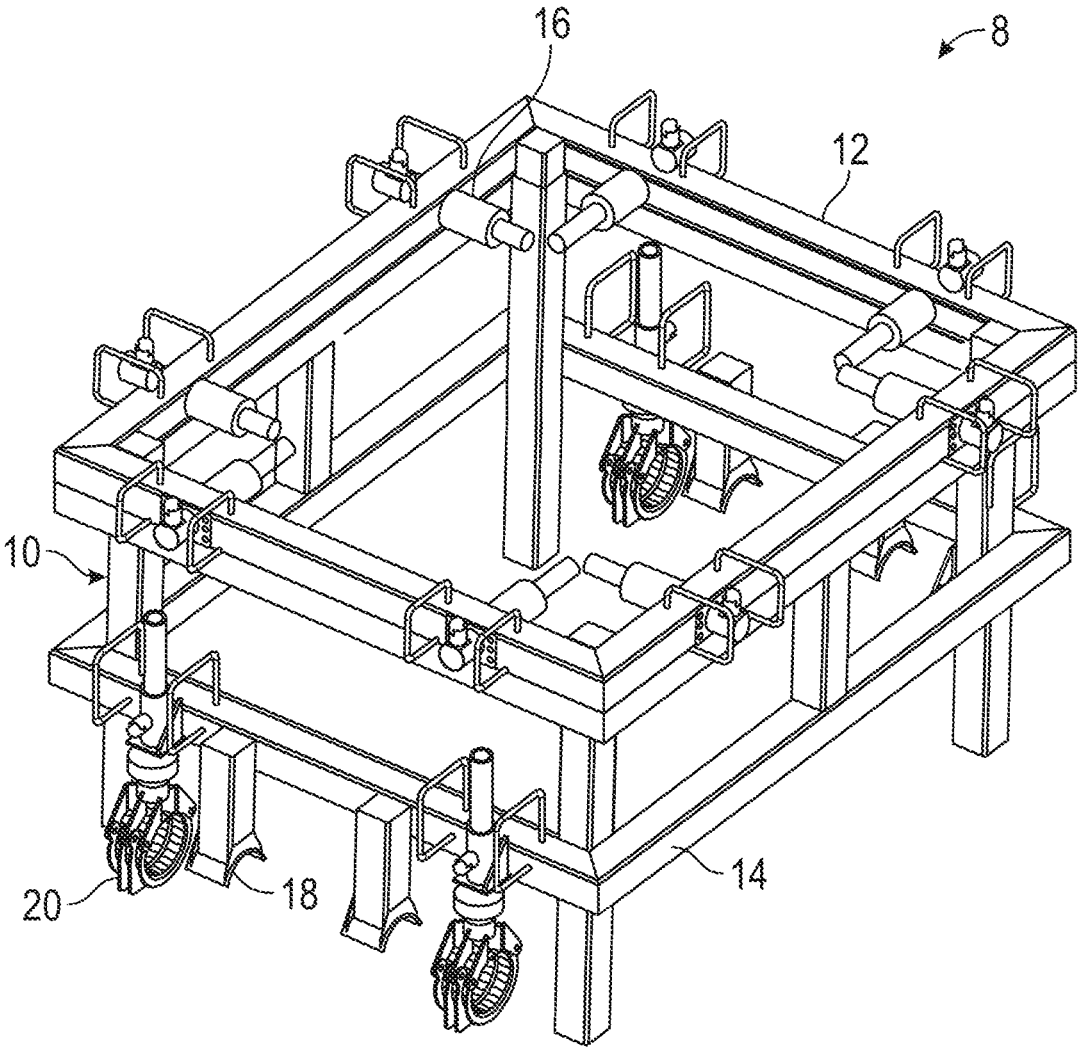
FIGS. 2 and 3 show a wellhead load relief device.
Figure 3:
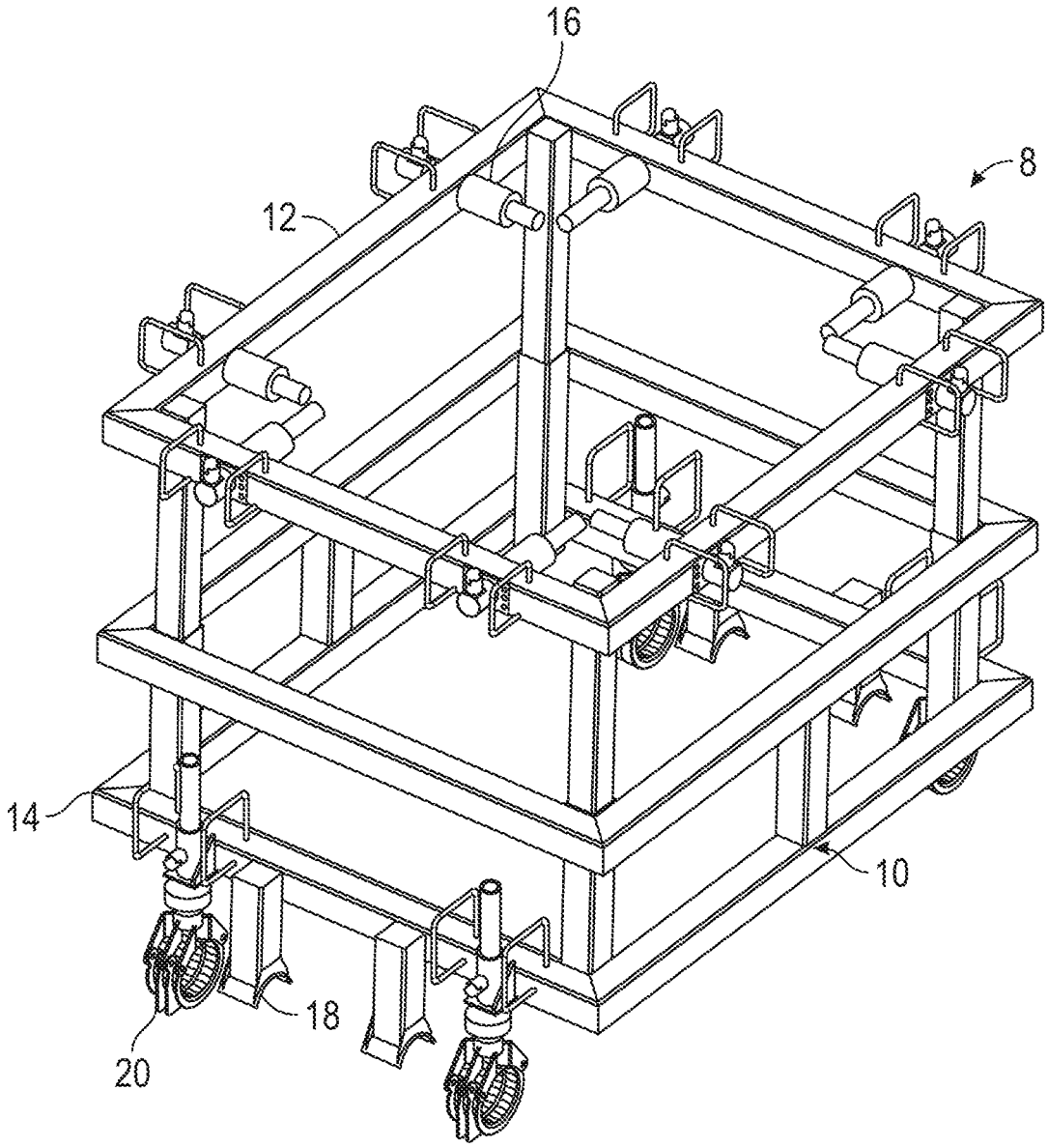

This wellhead load relief device 8 is shown in more detail in FIGS. 2 and 3. The wellhead load relief device 8 comprises a receptacle, e.g. frame, 10 that is made up of an upper part 12 and a lower part 14. The upper part 12 and the lower part 14 are movable relative to each other by means of a telescopic connection between the two parts 12, 14.

FIG. 2 shows the receptacle 10 in a retracted position and FIG. 3 shows the receptacle in an extended position.

The wellhead load relief device 8 comprises an adjustable support mechanism. In this example the adjustable support mechanism comprises eight support elements 16 in the form of extendable and retractable arms 16.

These arms 16 are for contacting and supporting well control equipment 6 received in the receptacle 10 of the wellhead load relief device 8. Each arm 16 can be extended and retracted by use of an ROV.

The wellhead load relief device 8 also comprises four support pads 18 that are for contacting and supporting the wellhead load relief device 8 on a subsea template 4. The wellhead load relief device 8 also comprises four connectors 20 that are for latching the wellhead load relief device 8 to the template 4 (or some other means/structure that provides a load path to the seabed). The support pads 18 and connectors 20 are used to provide a rigid connection between the wellhead load relief device 8 and the seabed (in this case via the template 4) so that loads can be efficiently transferred from the well control equipment 6 to the template 4 and ultimately into the seabed rather than being directed into the wellhead 2.

Figure 4:
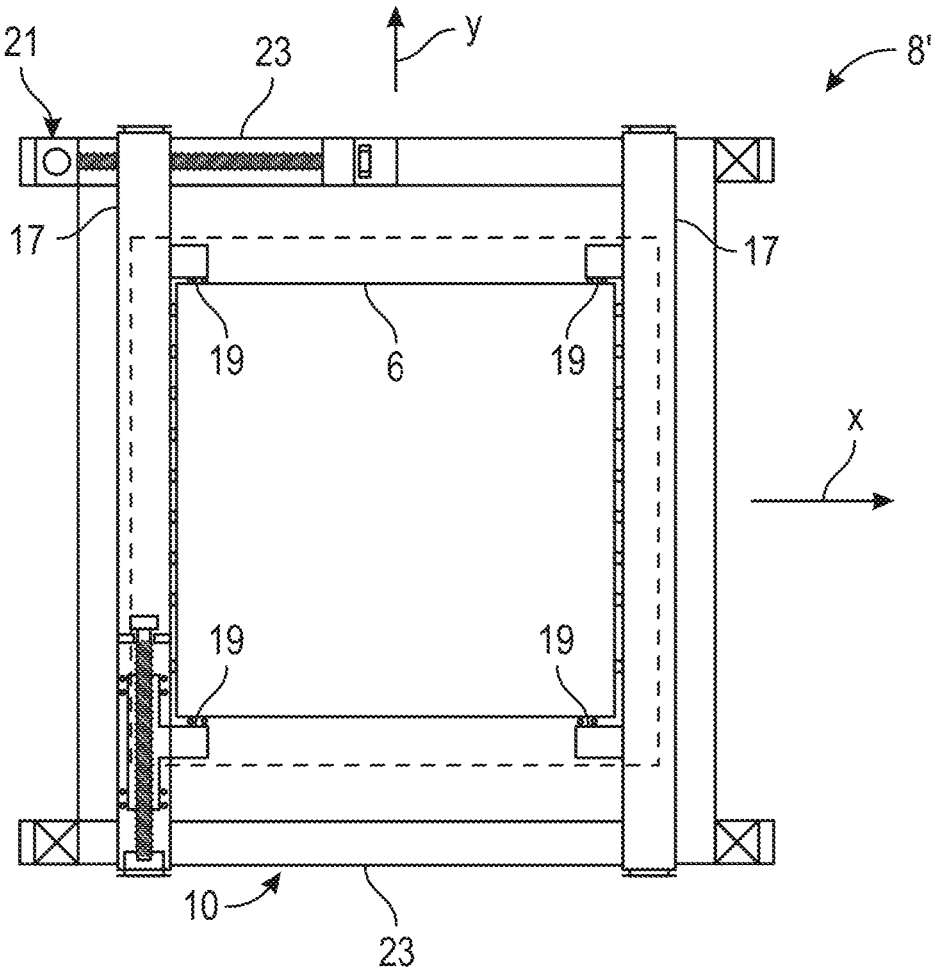
FIG. 4 shows a plan view of another wellhead load relief device.

FIG. 4 shows in plan view another exemplary wellhead load relief device 8'. In this example the adjustable support mechanism is provided by two opposite transverse beams 17 that are adjustable in the X-direction. Each transverse beam 17 moves in an opposite direction to the other beam 17 such that when they are moved they move towards or away from each other.

Each transverse beam 17 comprises two lateral supports 19 that are each independently movable in the Y-direction which is perpendicular to the X-direction. The lateral supports 19 are integrated into the respective transverse beams 17.

The transverse beams 17 are driven by the same adjustment mechanism, in this case by synchronised worm gears 21.

The lateral supports 19 are arranged to be driven individually.

All of the beams and supports 17, 19 may be operated by a ROV class 4 torque tool.

The device 8' comprises fixed beams 23 that form part of the receptacle and that provide support and housing for the adjustment means for the transverse beams 17.

Whilst the remaining figures show an assembly with a device 8 as shown in FIGS. 2 and 3, the assembly could alternatively comprise a well head load relief device of the type shown in FIG. 4, or any other wellhead load relief device with a receptacle and adjustable support members.

FIGS. 5 to 10 show an exemplary installation method.

Figure 6:
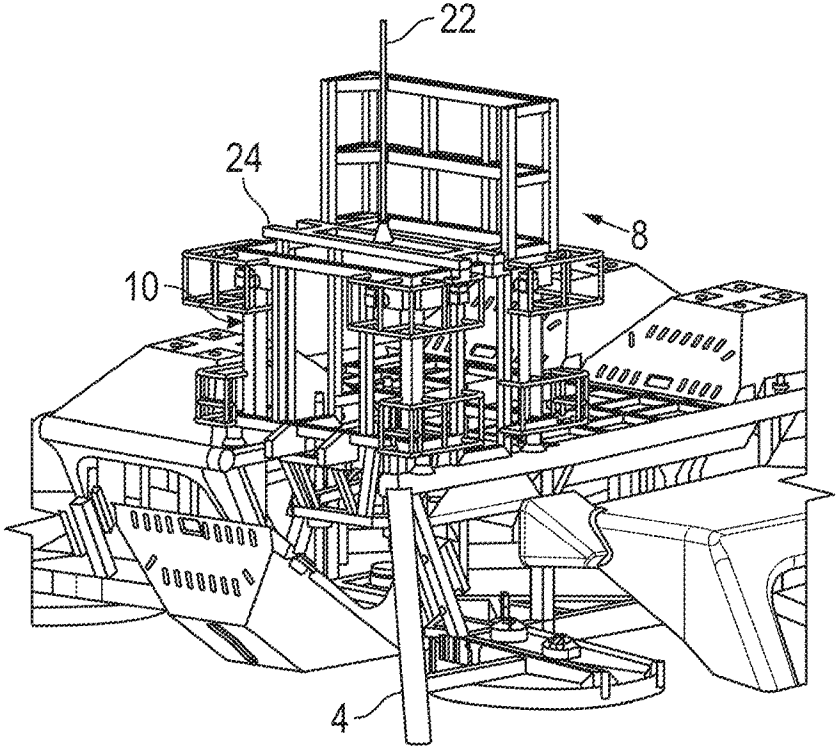
FIGS. 5 to 10 illustrate a method of installing a subsea wellhead assembly comprising the wellhead load relief device.
Figure 5:
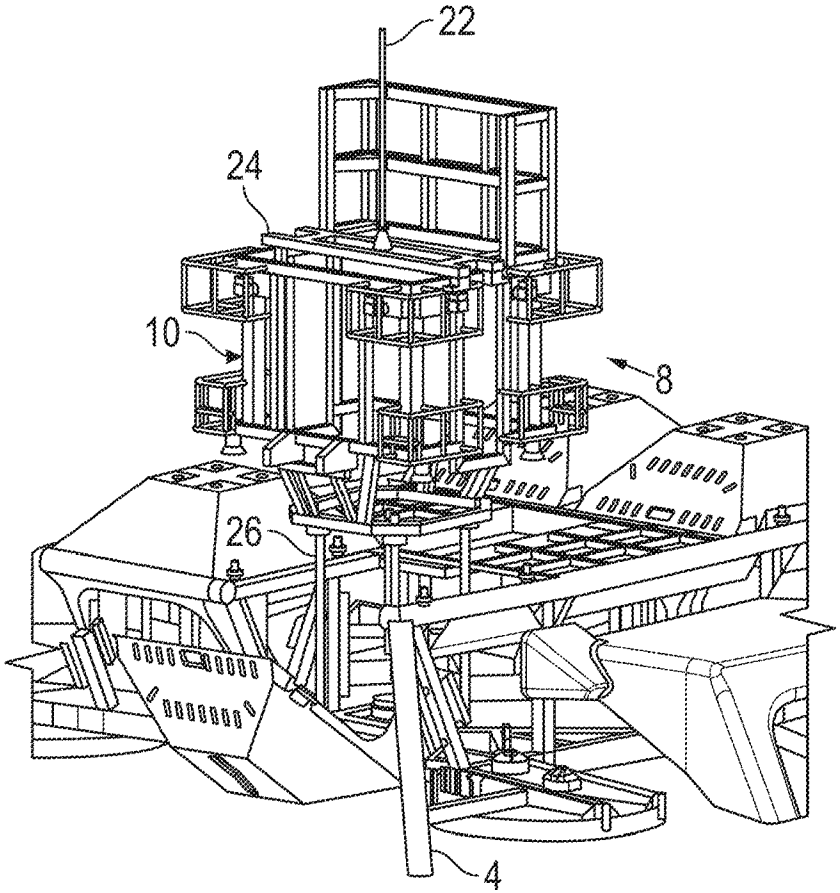

FIG. 5 shows the wellhead load relief device 8 (before the well control equipment 6 is located in the receptacle 10) being lowered by means of a lifting wire 22 connected to a lifting device 24 that is latched onto the receptacle 10. The wellhead load relief device 8 is lowered to a location above the wellhead 2 and then is guided by means of guide posts 26 down onto the template 4 until the wellhead load relief device 8 contacts the template 4 as shown in FIG. 6. The wellhead load relief device 8 may then be latched to the template 4 by the connectors 20 using ROVs. At that point the lifting device 24 may be disconnected from the receptacle 10 and lifted away by the lifting wire 22.

Once the wellhead load relief device 8 has been latched onto the template 4 well control element 6 can be installed in the receptacle 10 of the wellhead load relief device as shown in FIGS. 7 to 10.

Figure 8:
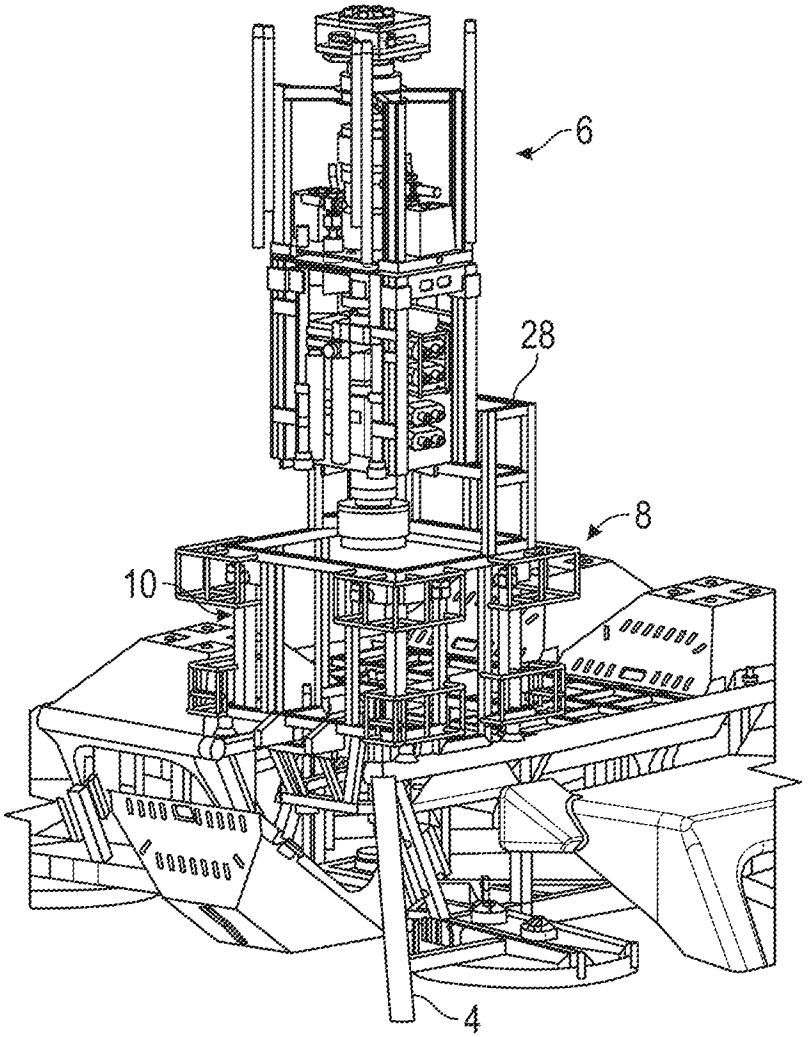
Figure 7:
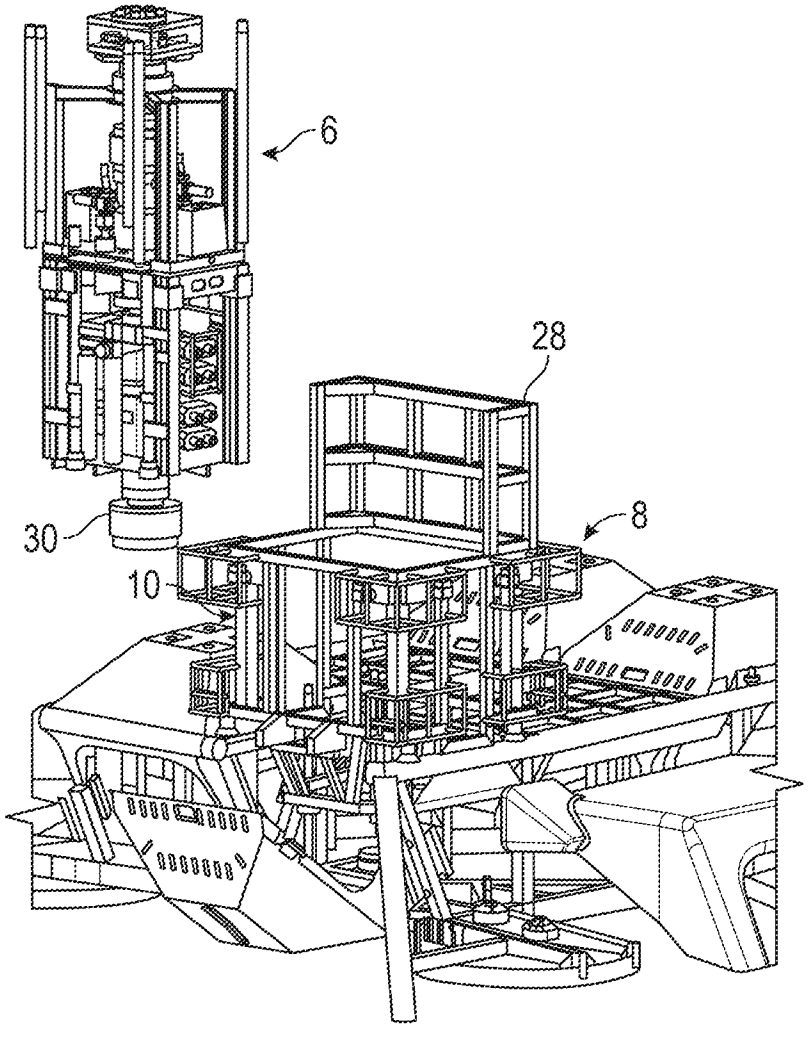

The well control element (e.g. BOP 6) may be lowered in a known manner until it is just above the height of the top of the receptacle 10 as shown in FIG. 7. The well control element 6 may then be moved laterally above the height of the top of the receptacle 10 until it contacts a receptacle extension 28 as shown in FIG. 8.

Figure 10:
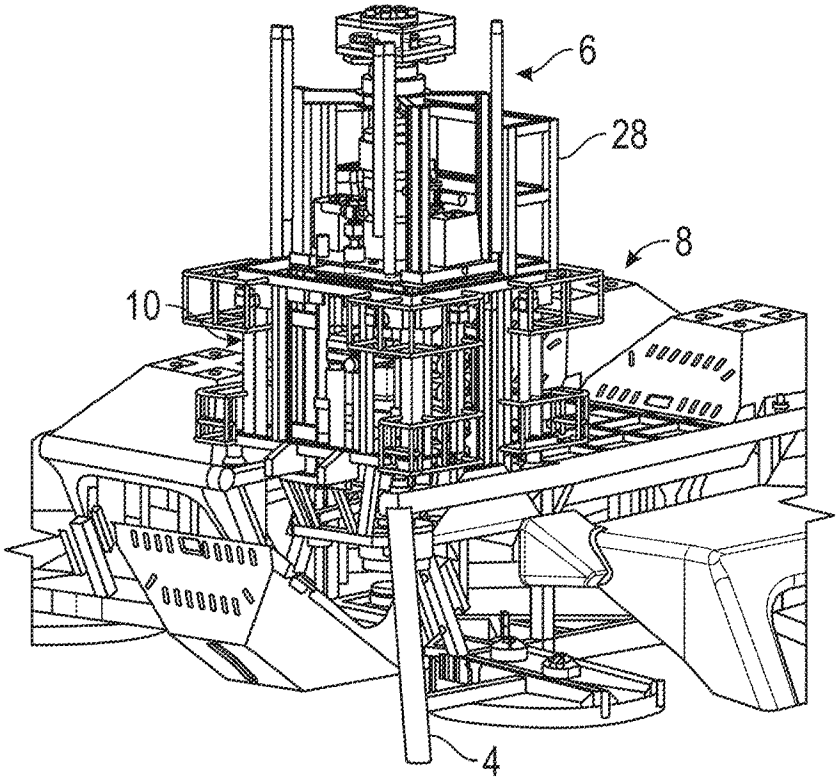
Figure 9:
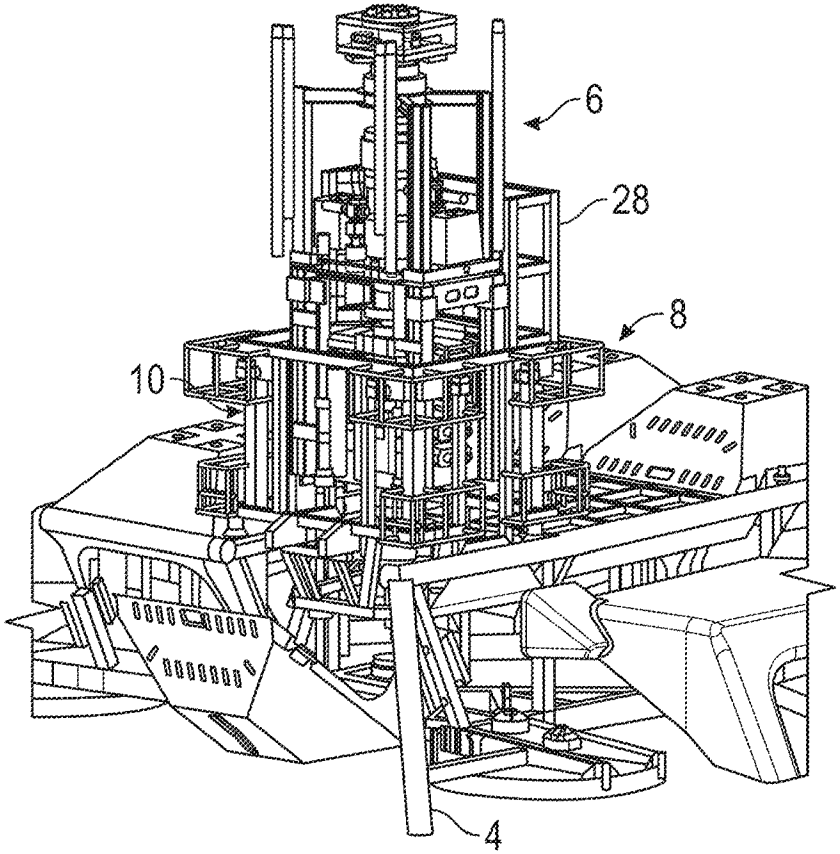

The BOP 6 may then be lowered into the receptacle 10 as shown in FIGS. 9 and 10. Once inside the receptacle 10 the BOP 6 may be connected to the wellhead 2 by connector 30. The support mechanism 16, 17, 19 may be adjusted until it contacts and supports the BOP 6 mounted within the device 8, 8'.

After the BOP 6 has been installed, if desired the receptacle extension 28 may be removed.

Figure 12:
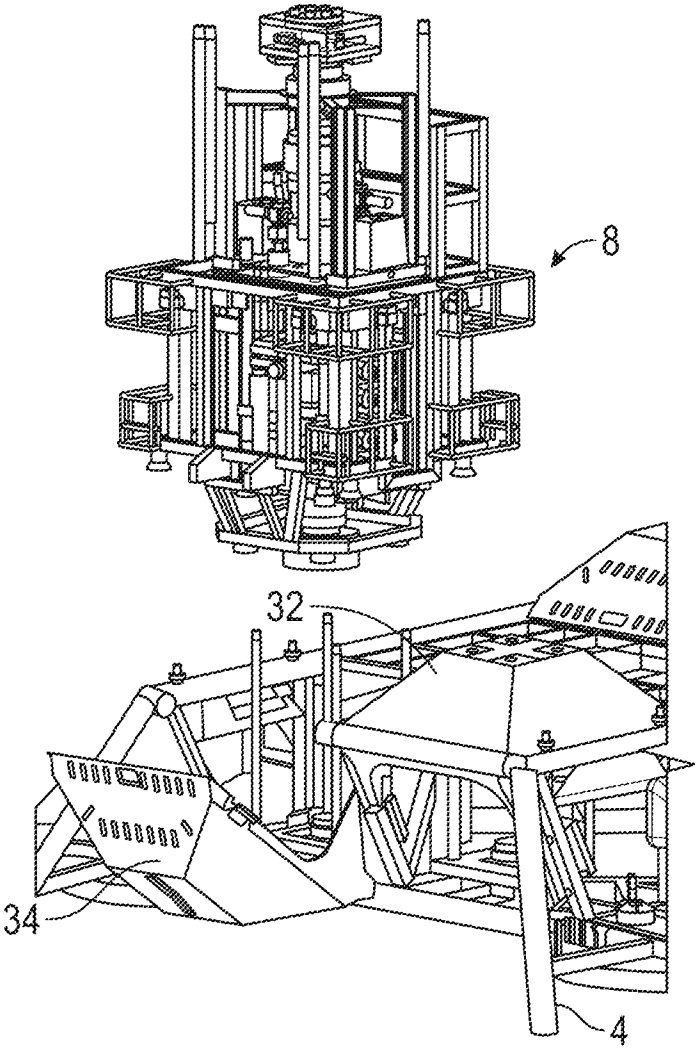
FIGS. 11 and 12 illustrate a method of moving well control equipment from a first wellhead to a second wellhead using a wellhead load relief device.
Figure 11:
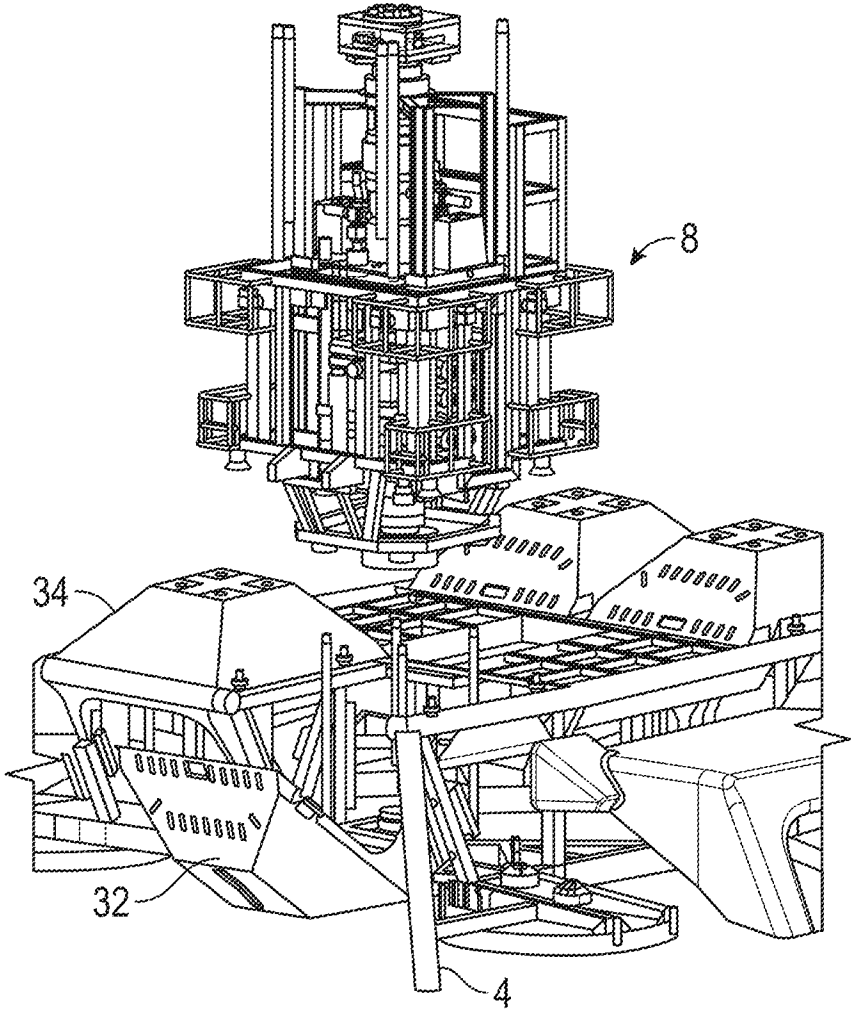

FIGS. 11 and 12 illustrate a method of using the wellhead load relief device 8 to move the well control equipment 6 from one wellhead 2 to another wellhead 2.

The method may comprise disconnecting the wellhead load relief device 8 from the template 4 and disconnecting the well control equipment 6 from the well head 2. These steps may be performed in either order or simultaneously.

The wellhead load relief device 8 may then be lifted with the BOP 6 within the receptacle 10 and moved laterally until the wellhead load relief device 8 with the well control equipment 6 located therein is above a second wellhead 2.

The protective cover 32 may then be placed back on the template 4 over the first wellhead 2 and the protective cover 34 may be taken off the template 4 to expose the second wellhead 2.

The wellhead load relief device 8 may then be lowered towards and onto the second wellhead 2. The method may then comprise connecting the wellhead load relief device 8 to the foundation 4 at a position located about the second wellhead 2 and connecting the well control equipment 6 to the second wellhead 2.

FIGS. 13 to 16 show schematically some alternative arrangements for guiding the well control equipment 6 into the receptacle 10 of the wellhead load relief device 8.

Figure 13:
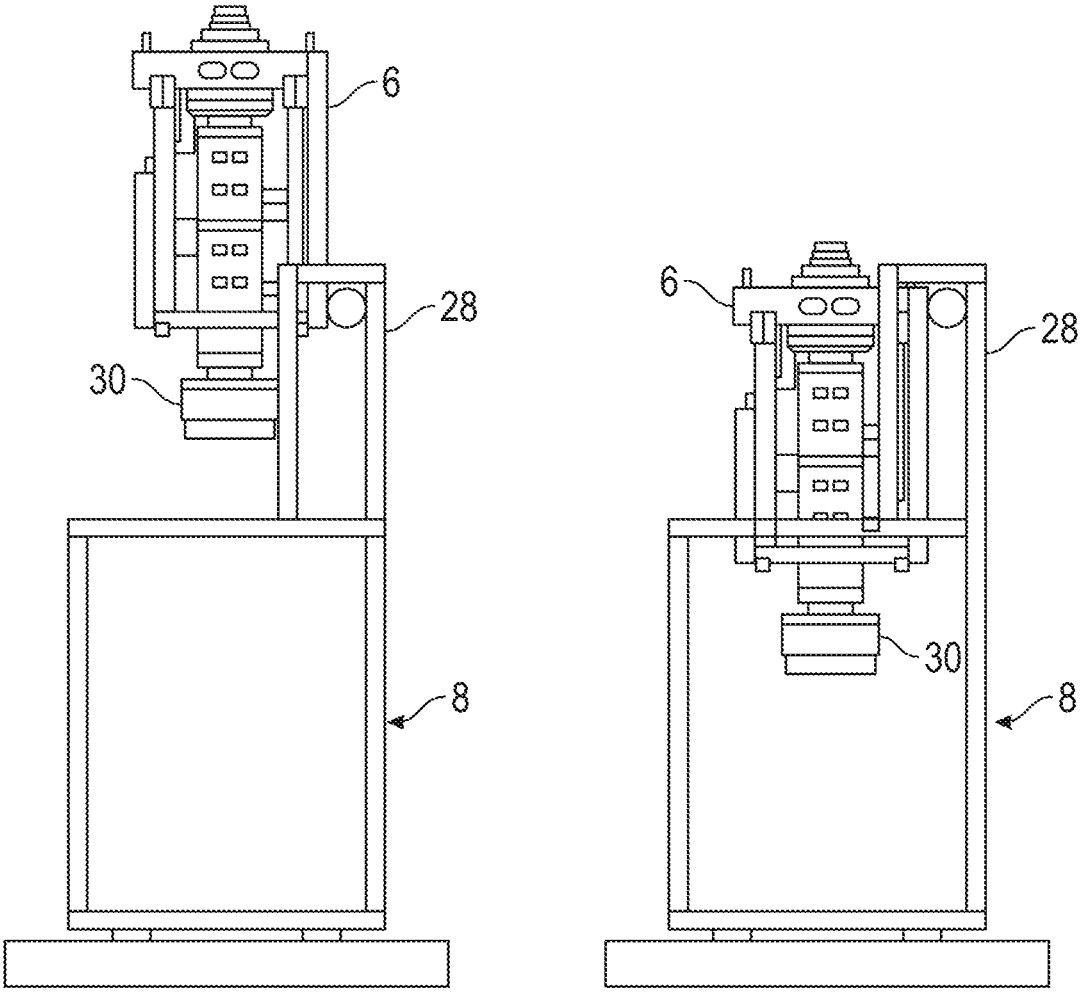
FIGS. 13 to 16 illustrate methods for locating the well control equipment within the wellhead load relief device.

FIG. 13 shows a receptacle extension 28 that has already been described in relation to FIGS. 5 to 12.

Figure 14:
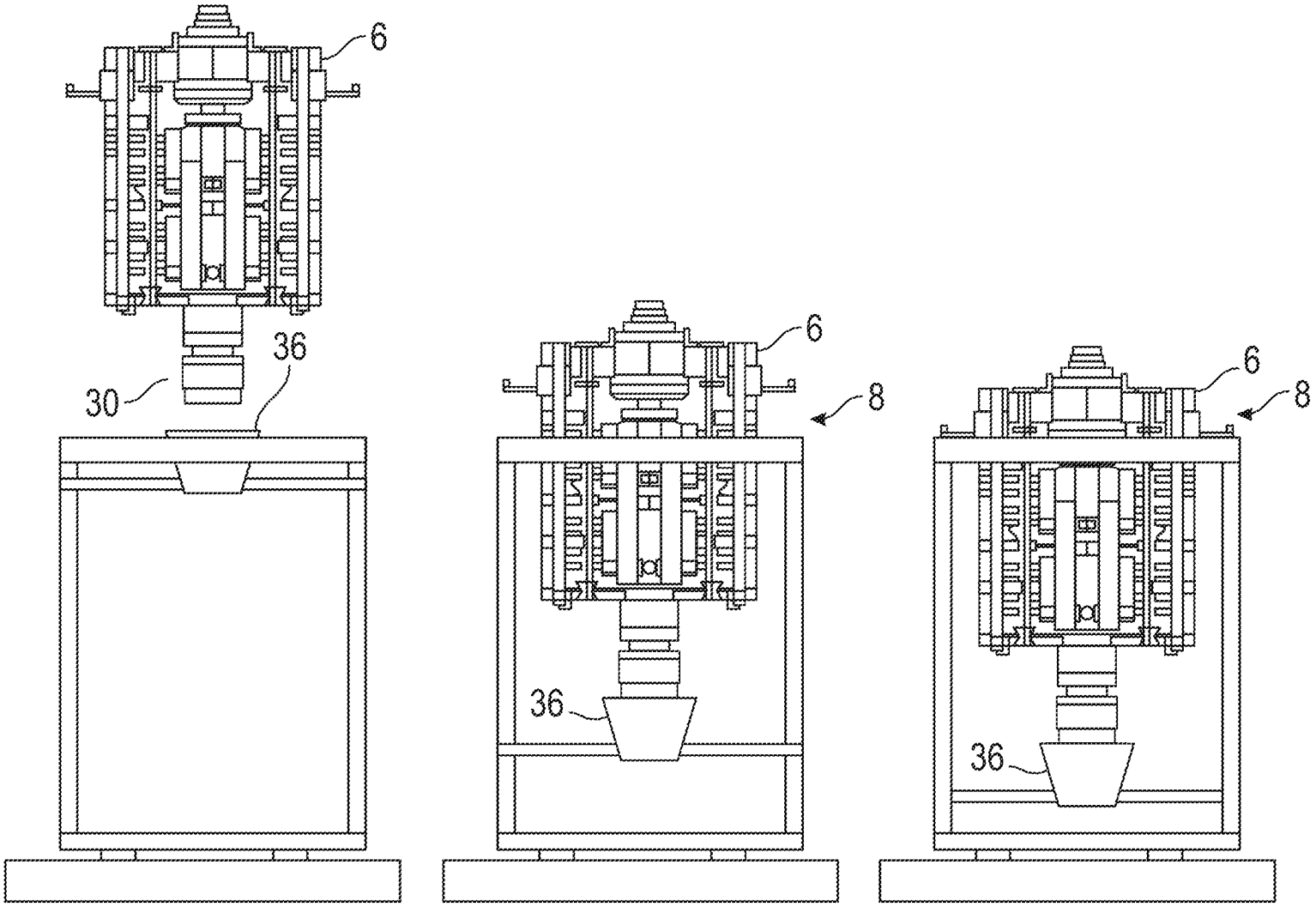

FIG. 14 shows an arrangement with a funnel 36 that is movable (e.g. slidable) in the axial direction of the wellhead load relief device 8. During installation, the funnel 36 may be located towards the top of the wellhead load relief device 8 to receive a bottom part (e.g. connector 30) of the subsea well control equipment 6. Once part of the wellhead control equipment 6 is received in the funnel 36, the funnel 36 may be lowered into the receptacle 10 and thereby lowering and guiding the well control equipment 6 into the receptacle 10 of the wellhead load relief device 8.

Figure 15:
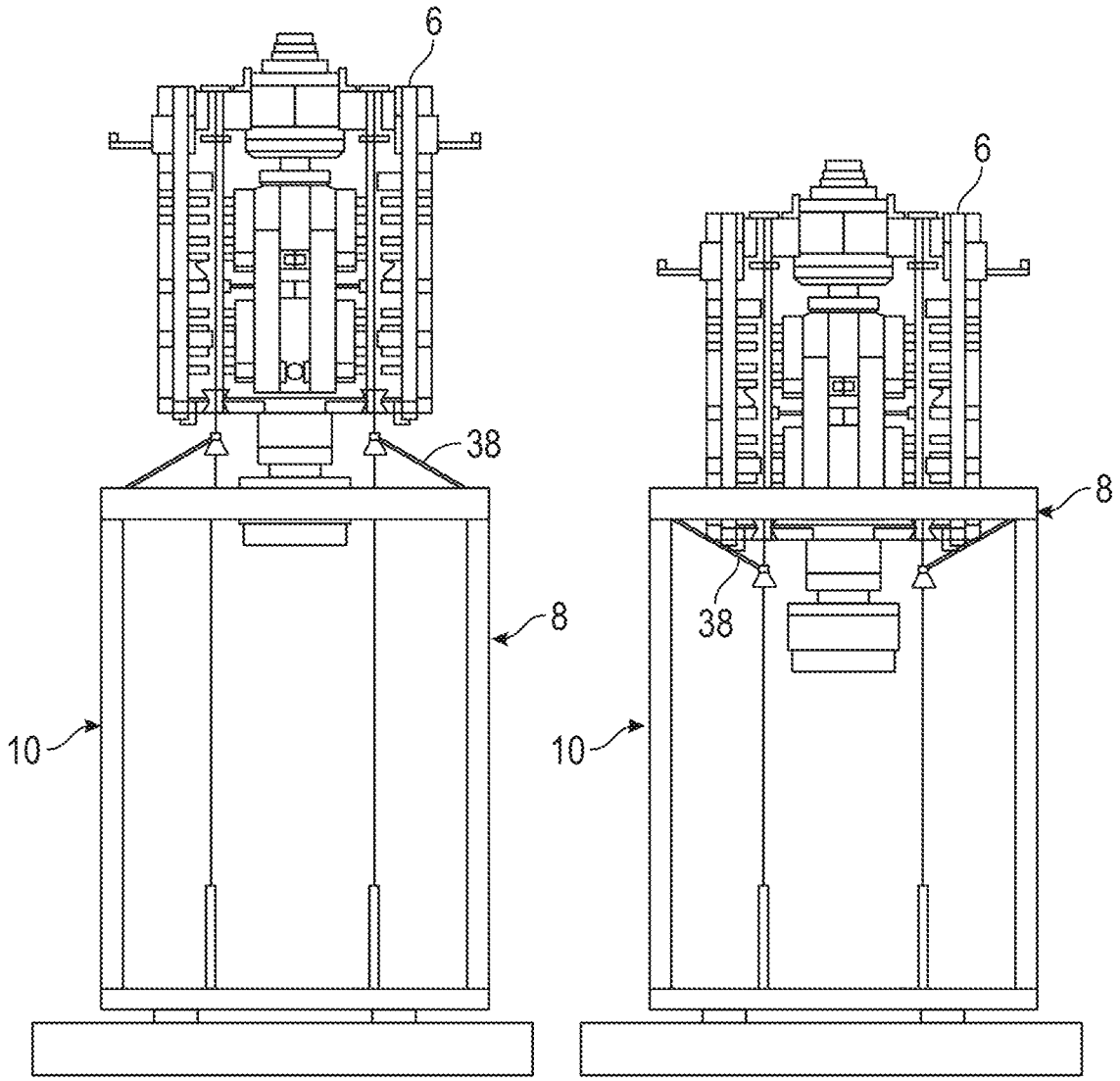

The guide may comprise one or more foldable latch arms 38 as shown in FIG. 15. During installation, these arms 38 may be located upwards out of the receptacle 10 and may be arranged to receive and attach to a bottom part of the subsea well control equipment 6. Once part of the well control equipment 6 is received by the foldable latch arms 38, the arms may be retracted/collapsed into the receptacle 10 to thereby lower and guide the well control equipment 6 into the receptacle 10 of the wellhead load relief device 8. Guide wires may be threaded through the foldable latch arms 38 to aid in guiding the well control equipment 6 into the receptacle 10.

Figure 16:
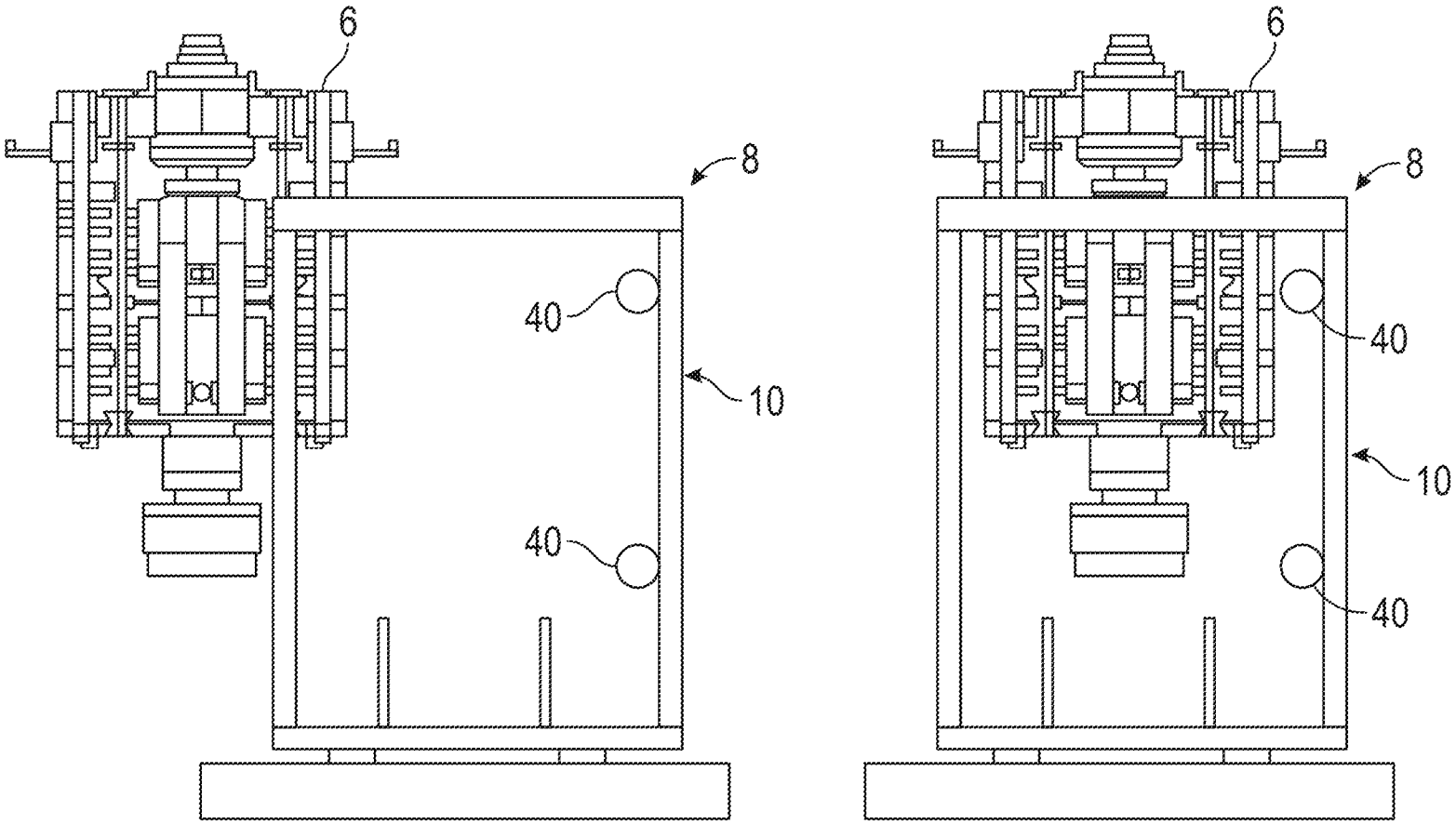

As shown for example in FIG. 16, the receptacle 10 may be have an access on one side that allows the well control equipment 6 to be guided in laterally into the receptacle 10 rather than lowering it axially into the receptacle 10. In this case the wellhead load relief device 8 may comprise bumpers 40 on the side of the receptacle 10 opposite the access opening so as to cushion the contact of the well control equipment 6 on the side of the receptacle opposite the access opening. Once the well control equipment 6 contacts the bumpers 40 the well control equipment may be lowered further so it can be latched to a wellhead 2.

The invention claimed is:

1. A wellhead load relief device for reducing riser system induced load effects on a subsea wellhead, the wellhead load relief device comprising:

a receptacle for receiving well control equipment, wherein the receptacle has an open top to permit the well control equipment to be received in the receptacle; and an adjustable support mechanism for rigidly supporting the well control equipment received in the receptacle wherein the adjustable support mechanism is located within the receptacle of the wellhead load relief device and wherein the adjustable support mechanism has a lateral extent that is adjustable relative to the receptacle, and wherein the wellhead load relief device is for providing a load path for forces exerted on the well control equipment to the seabed without going via the subsea wellhead.

2. A wellhead load relief device according to claim 1, wherein the adjustable support mechanism is adjustable to change the minimum inner dimension of the receptacle.

3. A wellhead load relief device according to claim 1, wherein the adjustable support mechanism comprises adjustable support elements, and the adjustable support elements comprise beams.

4. A wellhead load relief device according to claim 3, wherein each adjustable support element is opposite another support element, and the adjustable support elements are provided at or towards the corners of the receptacle.

5. A wellhead load relief device according to claim 3, wherein the adjustable support elements are arranged so that at least some of the adjustable support elements are adjusted together by a single adjustment mechanism, and wherein each adjustable support element is arranged so that it can be adjusted using a remote operated vehicle.

6. A wellhead load relief device according to claim 1, wherein the wellhead load relief device comprises a plurality of connectors for latching the wellhead load relief device to a foundation, and wherein the connectors are attached to the receptacle near the bottom of the receptacle.

7. A wellhead load relief device according to claim 1, wherein the receptacle has an adjustable height.

8. A wellhead load relief device according to claim 1, wherein the receptacle has a top part and a bottom part, wherein the top part can be moved relative to the bottom part, wherein the receptacle comprises a telescopic connection between the top and bottom parts that permits the height of the receptacle to be adjusted, and wherein the wellhead load relief device comprises an actuator that can be used to control the extension and retraction between the top part and bottom part of the receptacle.

9. A wellhead load relief device according to claim 1, wherein the wellhead load relief device comprises a guide for guiding well control equipment into an appropriate position for being lowered into the receptacle and/or guiding the well control equipment into the receptacle, wherein the guide comprises a receptacle extension that extends from and above one side of the receptacle, and wherein the receptacle extension is for guiding the well control equipment into a suitable location above the receptacle to then be lowered into the receptacle.

10. A subsea wellhead assembly, the assembly comprising:

the wellhead load relief device according to claim 1;

a subsea wellhead; and well control equipment attached to the subsea wellhead and located within the receptacle, wherein the adjustable support mechanism supports the well control equipment within the receptacle.

11. A subsea wellhead assembly according to claim 10, wherein the assembly comprises a foundation that is connected to the seabed, and the wellhead load relief device is connected to the foundation.

12. A subsea wellhead assembly according to claim 10, wherein brackets are mounted on the well control equipment and are for being the contact points on the well control equipment for the adjustable support mechanism.

13. A subsea wellhead assembly according to claim 10, wherein the well control equipment is a blowout preventer (BOP).

14. A method of installing a subsea wellhead assembly, the method comprising:

providing a wellhead load relief device according to claim 1;

connecting the wellhead load relief device to the seabed;

locating well control equipment within the receptacle;

attaching the well control equipment to a subsea wellhead; and adjusting the adjustable support mechanism until it supports the well control equipment within the receptacle.

15. A method of installing a subsea wellhead assembly according to claim 14, wherein adjusting the adjustable support mechanism comprises adjusting the elevation of the adjustable support mechanism relative to the well control equipment and adjusting the lateral position of the adjustable support mechanism.

16. A method of moving well control equipment from a first wellhead to a second wellhead, the method comprising:

providing a subsea wellhead assembly comprising a first wellhead, well control equipment mounted on the first wellhead; and a wellhead load relief device according to claim 1; wherein the wellhead load relief device is connected to the seabed;

disconnecting the wellhead load relief device from the seabed;

disconnecting the well control equipment from the well head;

moving the wellhead load relief device with the well control equipment located therein to above a second wellhead;

connecting the well control equipment to the second wellhead; and reconnecting the wellhead load relief device to seabed.

17. A method of moving well control equipment from a first wellhead to a second wellhead according to claim 16, wherein the method comprises retracting a lower part of the receptacle relative to the top part before moving the wellhead load relief device to be above a second wellhead.

18. A method of moving well control equipment from a first wellhead to a second wellhead according to claim 16, wherein the method comprises releasing the adjustable support mechanism before the well control equipment is released from the first wellhead and reactivating the adjustable support mechanism after the well control equipment has been attached to the second wellhead.

19. A method of uninstalling well control equipment, the method comprising:

providing a subsea wellhead assembly comprising a wellhead, well control equipment mounted on the first wellhead; and a wellhead load relief device according to claim 1, wherein the wellhead load relief device is connected to the seabed;

disconnecting the wellhead load relief device from the seabed;

disconnecting the well control equipment from the wellhead; and retrieving the well control equipment to the surface; and retrieving the wellhead load relief device to the surface.

20. A method of uninstalling well control equipment according to claim 19, wherein the well control equipment is retrieved to the surface separately to the wellhead load relief device, or wherein the well control equipment is retrieved to the surface together with the wellhead load relief device.

* * * * *